US011772380B2

(12) United States Patent
Narumi et al.

(10) Patent No.: US 11,772,380 B2
(45) Date of Patent: Oct. 3, 2023

(54) PRINTING APPARATUS, CONTROL METHOD THEREOF AND STORAGE MEDIUM

(71) Applicant: CANON KABUSHIKI KAISHA, Tokyo (JP)

(72) Inventors: Kazuki Narumi, Komae (JP); Masataka Kato, Yokohama (JP); Toshimitsu Danzuka, Tokyo (JP); Yasunori Fujimoto, Inagi (JP); Shin Genta, Yokohama (JP); Tomoki Yamamuro, Kawasaki (JP); Hiroto Kango, Tokyo (JP); Kazuhiko Sato, Tokyo (JP); Kazuo Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/570,260

(22) Filed: Jan. 6, 2022

(65) Prior Publication Data

US 2022/0126584 A1 Apr. 28, 2022

Related U.S. Application Data

(63) Continuation of application No. 16/855,250, filed on Apr. 22, 2020, now Pat. No. 11,247,471.

(30) Foreign Application Priority Data

Apr. 25, 2019 (JP) ..... 2019-083712

(51) Int. Cl.
*B41J 2/165* (2006.01)

(52) U.S. Cl.
CPC ..... *B41J 2/1652* (2013.01); *B41J 2/16508* (2013.01); *B41J 2/16523* (2013.01); *B41J 2/16532* (2013.01)

(58) Field of Classification Search
CPC .. B41J 2/1652; B41J 2/16508; B41J 2/16523; B41J 2/16532; B41J 2/17506
See application file for complete search history.

(56) References Cited

U.S. PATENT DOCUMENTS 6,854,826 B2 2/2005 Kanda et al. ..... 347/29
8,794,737 B2 * 8/2014 Taira ..... B41J 2/16532 347/30

(Continued)

FOREIGN PATENT DOCUMENTS

JP H07-256895 10/1995
JP 2012-011592 1/2012

(Continued)

OTHER PUBLICATIONS

Office Action dated Feb. 21, 2023 in counterpart Japanese Application No. 2019-083712, together with English translation thereof.

(Continued)

*Primary Examiner* — Geoffrey S Mruk
(74) *Attorney, Agent, or Firm* — Venable LLP

(57) ABSTRACT

The object of the present disclosure is to optimize the time necessary for filling and the ink consumption. One embodiment of the present disclosure is a printing apparatus having: a storage unit; a print head having an ejection port from which ink supplied from the storage unit is ejected; an ink supply path that connects the storage unit and the print head; a suction unit configured to perform suction at the ejection port; and a supply control unit configured to supply ink stored in the storage unit to the ink supply path and the print head by performing suction at the ejection port by the suction unit, and the printing apparatus has an acquisition unit configured to acquire information relating to ink discharge from the ink supply path and the supply control unit (Continued)

determines the number of times of suction by the suction unit based on the information.

15 Claims, 11 Drawing Sheets

(56) References Cited

U.S. PATENT DOCUMENTS

| | | | | |
|---|---|---|---|---|
| 8,882,232 | B2 | 11/2014 | Ibe et al. | 347/19 |
| 8,944,562 | B2 | 2/2015 | Nakagawa et al. | 347/30 |
| 9,561,658 | B2 | 2/2017 | Danzuka et al. | B41J 2/16508 |
| 2015/0062231 | A1 | 3/2015 | Danzuka et al. | 347/19 |

FOREIGN PATENT DOCUMENTS

| | | | |
|---|---|---|---|
| JP | 2012-045892 | A | 3/2012 |
| JP | 2015-44357 | | 3/2015 |
| JP | 2015-044357 | A | 3/2015 |
| JP | 2015-080878 | | 4/2015 |

OTHER PUBLICATIONS

Japanese Office Action dated Jun. 6, 2023 in counterpart Japanese Patent Appln. No. 2019-083712.

* cited by examiner

PRINTING APPARATUS, CONTROL METHOD THEREOF AND STORAGE MEDIUM

This application is a continuation of application Ser. No. 16/855,250 filed Apr. 22, 2020, currently pending; and claims priority under 35 U.S.C. § 119 to Japan Application JP 2019-083712 filed in Japan on Apr. 25, 2019; and the contents of all of which are incorporated herein by reference as if set forth in full.

BACKGROUND OF THE INVENTION

Field of the Invention

The present application relates to a printing apparatus, a control method thereof, and a storage medium.

Description of the Related Art

Conventionally, the ink jet printing technique has been widely researched and developed in view of advantages, such as that printers can be manufactured at comparatively low costs, and an ink jet printing apparatus has prevailed widely as consumer equipment, such as a printer and a multifunction peripheral.

Further, in recent years, the demand to increase the amount of ink that is stored within the ink jet printing apparatus is increasing. Because of this, a printer having a sub tank for storing ink, in addition to an ink tank, has been proposed. By providing a sub tank, it is made possible to continue printing without interruption even while a user is exchanging an ink tank with another. Among the ink jet printing apparatuses, many of them adopt a method of keeping the pressure within the print head negative, that is, a so-called water head difference method, by providing an atmosphere communication opening in an ink storage unit, such as a sub tank, and designing so that the ink liquid surface within the ink storage unit is lower than the ink ejection port in the gravitational direction.

In a case where the ink jet printing apparatus adopting the water head difference method is inclined considerably, the relationship between the water head differences changes, and therefore, the pressure within the print head becomes positive or negative whose absolute value is large and there is a possibility that the meniscus formed at the ink ejection port is destroyed. In a case where the meniscus at the ink ejection port is destroyed, there is a possibility that ink leaks out of the ink ejection port or the atmosphere communication opening of the ink storage unit. In order to prevent the ink leakage due to inclination, it is known to pull out in advance the ink within the ink jet printing apparatus at the time of transport during which there is a possibility that the ink jet printing apparatus is inclined considerably. Hereinafter, movement (transport) in order to install a printer once installed at a certain position to another position is called secondary transport.

Japanese Patent Laid-Open No. 2015-44357 has disclosed that in a case where the secondary transport of an ink jet printing apparatus having a sub tank is performed, in accordance with the ink remaining amount at the time of start of the ink discharge operation before the secondary transport, the ink filling sequence after the secondary transport is changed. According to Japanese Patent Laid-Open No. 2015-44357, in a case where there is not a possibility that air enters the ink supply tube at the time of pulling out ink before the secondary transport, it is possible to reduce the ink consumption by minimizing the ink suction operation at the time of installation after the secondary transport.

SUMMARY OF THE INVENTION

However, Japanese Patent Laid-Open No. 2015-44357 does not take into consideration the state of the ink supply path after ink is pulled out and in a case where the printing apparatus having the ink supply path such as this is filled with ink, it is not possible to optimize the time necessary for filling and the ink consumption.

Consequently, in view of the above-described problem, an object of one embodiment of the present disclosure is to optimize the time necessary for filling and the ink consumption in a case where the printing apparatus in which ink has been pulled out of the ink supply path is filled with ink.

One embodiment of the present disclosure is a printing apparatus comprising: a storage unit configured to store ink; a print head having an ejection port from which ink supplied from the storage unit is ejected; an ink supply path that connects the storage unit and the print head; a suction unit configured to perform suction at the ejection port; and a supply control unit configured to supply ink stored in the storage unit to the ink supply path and the print head by performing suction at the ejection port by the suction unit, and the printing apparatus comprises an acquisition unit configured to acquire information relating to ink discharge from the ink supply path and the supply control unit determines a number of times of suction by the suction unit based on the information.

Further features of the present invention will become apparent from the following description of exemplary embodiments with reference to the attached drawings.

DESCRIPTION OF THE EMBODIMENTS

First Embodiment

The present embodiment relates to, for example, a liquid droplet ejection apparatus having a liquid droplet ejection unit configured to eject ink droplets from a plurality of ejection ports, such as an ink jet printing apparatus, and a liquid droplet ejection system including the ink droplet ejection apparatus and a control apparatus that controls the ink droplet ejection apparatus. Further, the present embodiment relates to a method of controlling the liquid droplet ejection apparatus and the ink droplet ejection system such as those, and a program.

<About Configuration of Print Head>

Figure 1:
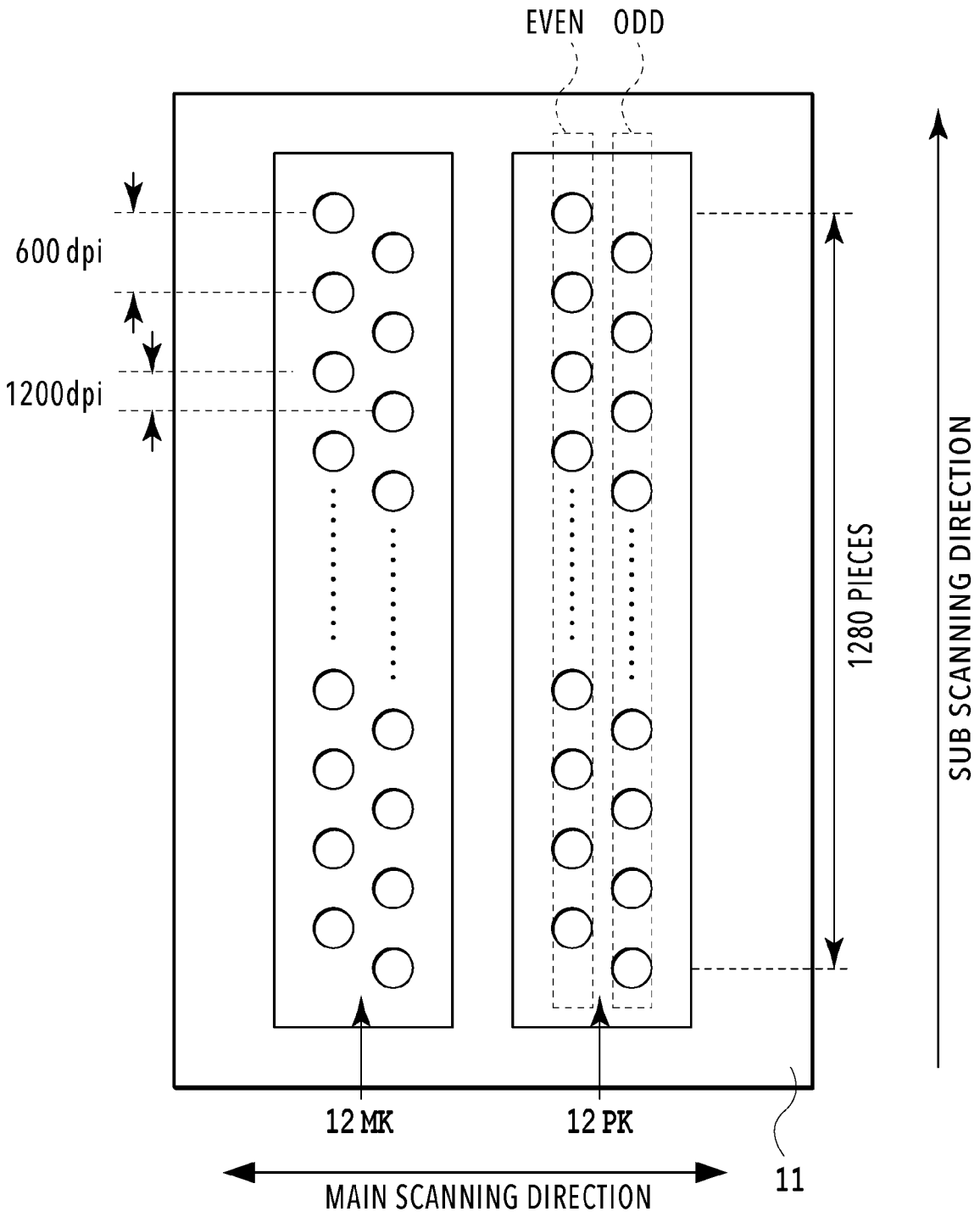
FIG. 1 is a diagram for explaining a configuration of a print head in a first embodiment.

In the following, the configuration of a print head, which is one part of an ink jet printing apparatus (hereinafter, simply described as "printing apparatus") in the present embodiment, is explained by using FIG. 1. FIG. 1 is a schematic diagram showing the printing element side of a print head 11 used in the present embodiment.

The print head 11 comprises a printing element column for each ink color, in which 1,280 printing elements (so-called nozzles and hereinafter, referred to as ejection ports) are arranged in the sub scanning direction at a density of 1,200 printing elements per inch. An ejection port column 12MK ejecting matte black ink and an ejection port column 12PK ejecting photo black ink are arranged side by side in the main scanning direction of the print head 11. In the ejection port column 12PK, two ejection port columns in which ejection ports are arranged at a density of 600 ejection ports per inch respectively are arranged in a staggered manner with a shift of 1/120 inches. By regarding these two columns (hereinafter, referred to as Even column and Odd column) as one ejection port column, it is possible to form 1,200 dots per inch on a printing medium. The ejection port column 12MK has the same configuration as that of the ejection port column 12PK.

The amount of ink droplet (ejection amount) ejected from each ejection port is about 4.5 pl. However, it may also be possible to set the ejection amount for the ejection port that ejects black ink, such as the photo black ink and the matte black ink, to an amount more than that for the ejection ports that eject the other color inks in order to implement a high density. The print head of the present embodiment is a print head that ejects ink by making use of thermal energy and comprises an electric thermal conversion member for generating thermal energy within the ejection port. The method of ejecting ink is not limited to the method that makes use of thermal energy and may be another method, such as a method that ejects ink by a piezoelectric element.

It is possible for the print head 11 to form a dot at a print density of 2,400 dpi (dot/inch) in the main scanning direction and at a print density of 1,200 dpi in the sub scanning direction by ejecting ink while scanning in the main scanning direction. It may also be possible to configure the print head 11 that ejects the two color inks, that is, the photo black ink and the matte black ink, independently for each color, or configure the print head 11 integrally. Further, it may also be possible to configure the printer as a color printer by adding the cyan ink, magenta ink, and yellow ink, in addition to the above-described two color inks. Furthermore, for the purpose of improving granularity, it may also be possible to add the light cyan ink and light magenta ink, or for the purpose of improving color developing, it may also be possible to add the red ink, green ink, and blue ink. The above is the contents of the configuration of the print head in the present embodiment.

<About Internal Configuration of Printing Apparatus>

Figure 2:
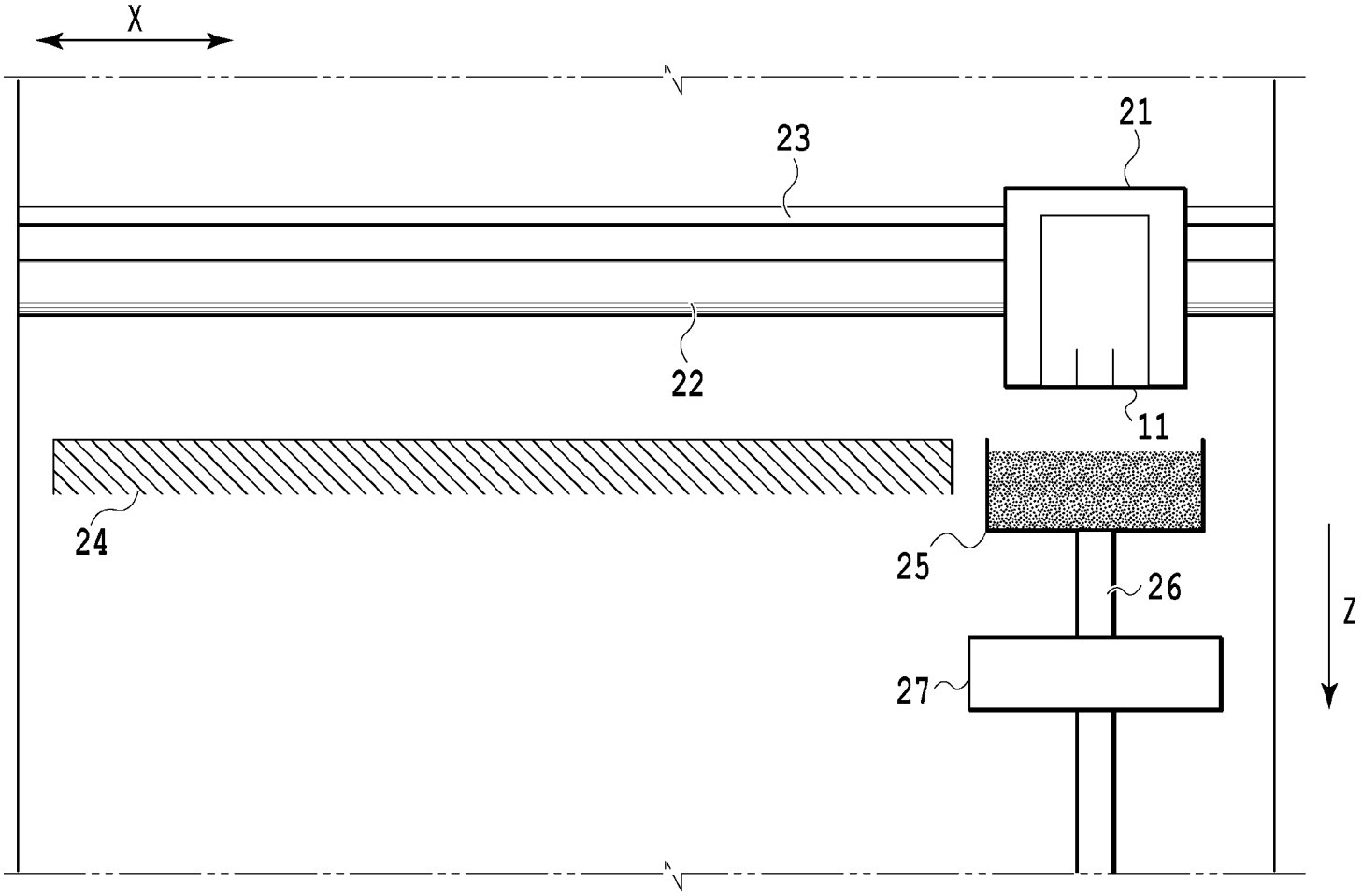
FIG. 2 is a sectional diagram for explaining an internal configuration of an ink jet printing apparatus in the first embodiment.

In the following, the internal configuration of the printing apparatus in the present embodiment is explained by using FIG. 2. FIG. 2 is a sectional diagram schematically showing the internal configuration of the printing apparatus.

A carriage 21 is penetrated through so as to be capable of performing a reciprocating scan while holding the print head 11 by being guided by a guide shaft 22 extending along the main scanning direction (in FIG. 2, X-direction) perpendicular to the sub scanning direction in which a printing medium 24 is conveyed. The drive of the carriage 21 is performed by pulling a drive belt 23 fixed on the carriage 21 by a carriage motor (not shown schematically) attached to the ink jet printing apparatus main body.

A pair of conveyance rollers (not shown schematically) conveys the printing medium 24 in the sub scanning direction accompanying the rotation thereof as well as nipping the printing medium 24. By the carriage 21 alternately repeating the printing operation to eject ink from the ejection port of the print head 11 based on the print data and the conveyance operation accompanying the rotation of the pair of conveyance rollers (not shown schematically) while moving in the main scanning direction, an image is formed stepwise on the printing medium.

The printing apparatus further has a cap 25 for suppressing evaporation of a solvent in the ink from the ejection port. It is possible for the cap 25 to move to a position (referred to as capping position) at which the cap 25 is in contact with the ejection port surface at which the ejection port of the print head 11 is formed and suppresses evaporation of the solvent in the ink and a position (referred to as separate position) at which the cap 25 is separate from the ejection port surface and does not suppress the evaporation. The cap 25 reciprocates between the capping position and the separate position along the gravitational direction (in the Z-direction in FIG. 2) by an arbitrary moving unit. FIG. 2 shows a case where the cap is located in the separate state.

Further, the cap 25 is connected to a suction pump 27 via a pump tube 26. In a case where the cap 25 is located at the capping position, by driving the suction pump 27, it is possible to suck and discharge ink from the ejection port columns 12MK and 12PK. The cap 25 is provided with an ink absorber and the ink that is sucked and discharged by the drive of the suction pump 27 is stored within a maintenance cartridge, not shown schematically. In the present embodiment, as the suction pump 27, a tube pump is adopted, but it may also be possible to adopt a suction pump of another method. The above is the contents of the internal configuration of the printing apparatus in the present embodiment.

<About Ink Supply System>

Figure 3:
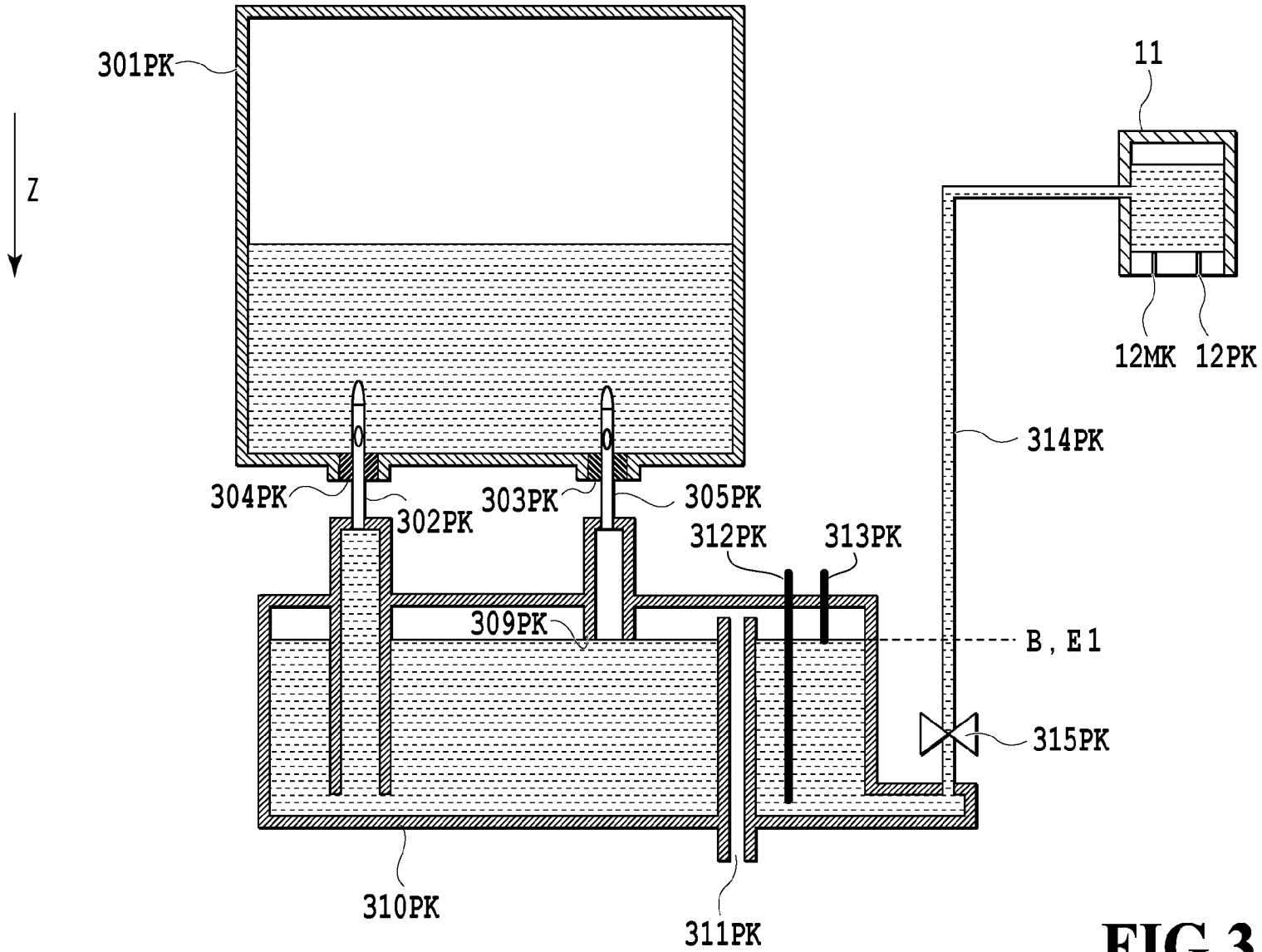
FIG. 3 is a diagram for explaining an ink supply system of the ink jet printing apparatus in the first embodiment.

In the following, the ink supply system of the printing apparatus in the present embodiment is explained by using FIG. 3. FIG. 3 is a sectional diagram schematically showing the ink supply system of the photo black ink in the printing apparatus.

The ink supply system has an ink tank 301PK and a sub tank 310PK as an ink storage unit capable of storing the photo black ink. While the ink tank 301PK is attached to the printing apparatus detachably, the sub tank 310PK is fixed to the printing apparatus.

At the top of the sub tank 310PK in the gravitational direction, a hollow supply needle 302PK is provided. In the state where the ink tank 301PK is attached to the printing apparatus, the supply needle 302PK penetrates through a rubber stopper 304PK provided to the ink tank 301PK. By the supply needle 302PK penetrating through the rubber stopper 304PK, the ink tank 301PK and the sub tank 310PK communicate with each other. Further, the ink tank 301PK and the sub tank 310PK communicate with each other also via a supply needle 305PK penetrating through a rubber stopper 303PK. The sub tank 310PK is provided with an atmosphere communication opening 311PK and in a case where the supply needle 305PK penetrates through the rubber stopper 303PK, the state is brought about where the photo black ink of the ink tank 301PK is capable of communicating with the atmosphere. Under the supply needle 305PK, a cylindrical opening 309PK is formed as a part of the sub tank 310PK. The opening 309PK has a role of specifying an interface between the ink of the sub tank 310PK and air and in a case where the opening 309PK is blocked by the ink liquid surface, the ink supply to the sub tank 310PK is terminated. That is, by the opening 309PK, the filled-up state of the sub tank 310PK is specified.

The ejection port column 12PK of the print head 11 communicates with the sub tank 310PK internally storing the photo black ink via an ink supply tube 314PK that functions as the ink supply path from the sub tank 310PK to the print head 11. In a case where the photo black ink stored in the sub tank 310PK is consumed by the ink being ejected from the ejection port for printing or the like, the liquid surface of the sub tank 310PK drops. Then, the opening 309PK and the ink liquid surface within the sub tank 310PK are separated from each other. As a result of that, the ink tank 301PK communicates with the atmosphere through the supply needle 305PK. By the ink tank 301PK communicating with the atmosphere, the ink liquid surface within the ink tank 301PK drops as well as air is discharged from the atmosphere communication opening 311PK, and therefore, the sub tank 310PK is filled with ink. That is, as long as the ink exists in the ink tank 301PK, the same amount of ink as that consumed in the print head 11 is supplied to the sub tank 310PK. In the state where the liquid surface has risen up to the position indicated by a broken line B in FIG. 3, the opening 309PK is blocked by the ink again and the movement of ink from the ink tank 301PK to the sub tank 310PK is terminated, that is, the filling of the sub tank 310PK is completed.

In addition, the sub tank 310PK is arranged so that the ink liquid surface within the sub tank 310PK is lower than the ejection port surface of the print head 11 in the gravitational direction. Because of this, by the so-called water head difference, the pressure within the print head 11 is kept negative. The sub tank 310PK is arranged so that the meniscus that is formed at the ejection port is not destroyed by this negative pressure. Further, in the ink supply tube 314PK connecting the sub tank 310PK and the print head 11, an opening/closing valve 315PK is arranged and the opening/closing valve 315PK opens and closes the ink flow path configured by the ink supply tube 314PK. At the time of transport of the printing apparatus, by closing the opening/closing valve 315PK, the ink leakage from the print head 11 is prevented.

Further, in the sub tank 310PK, an electrode 312PK and an electrode 313PK are provided. Then, by detecting the voltage value at the time of causing a weak current to flow between the two electrodes, whether or not the ink liquid surface within the sub tank 310PK is lower than the position in the vertical direction, which is indicated by a broken line E1 in FIG. 3, is detected. To explain in more detail, in a case where the ink liquid surface within the sub tank 310PK is at the same position as or above the position in the vertical direction, which is indicated by the broken line E1, on a condition that a weak current is caused to flow between the two electrodes, the current flows via the ink. Because of this, the detected voltage value at that time is lower than that in a case where the ink liquid surface is lower than the position in the vertical direction, which is indicated by the broken line E1. On the other hand, in a case where the ink liquid surface within the sub tank 310PK is lower than the position in the vertical direction, which is indicated by the broken line E1, even though an attempt is made to cause a weak current to flow between the two electrodes, the current does not flow via the ink. Because of this, the detected voltage value at the time of the attempt to cause the current to flow is relatively high.

As explained above by using FIG. 3, it is possible to detect whether or not the ink liquid surface within the sub tank 310PK is lower than the position in the vertical direction, which is indicated by the broken line E1. Hereinafter, the results of the detection operation of the ink amount such as this are referred to as "ink amount detection results". Further, a case where the ink amount is larger than a predetermined amount and the detected voltage value is relatively low is referred to as "ink sufficient" and on the other hand, a case where the ink amount is smaller than the predetermined amount and the detected voltage value is relatively high is referred to as "ink insufficient". Furthermore, the position in the vertical direction, which is indicated by the broken line E1, is referred to as "detection position". In the present embodiment, the amount of ink remaining within the ink supply system that communicates with the ejection port column 12PK in a case where the ink liquid surface within the sub tank 310PK is at the detection position is about 17 ml. In the present embodiment, the height of the liquid surface B at the time of termination of filling of ink from the ink tank to the sub tank and the height of the liquid surface E1 (hereinafter, detection surface E1) at which "ink insufficient" is detected are the same. That is, the configuration is such that "ink sufficient" is detected in the stage in which the ink filling is terminated.

In the present embodiment, the ink amount in the ink tank 301PK and the sub tank 310PK is detected based on the value of a dot counter, in addition to the two electrodes 312PK and 313PK. It is possible to implement the dot counter by the control unit, to be described later. The dot counter accumulatively counts the value obtained by multiplying the number of ejected ink droplets by the volume per droplet and the suction and discharge amount by the suction pump 27.

It is made possible to easily manage the ink amount by providing a memory for managing the ink amount within the tank in the ink tank 301PK and storing the dot count value in the memory. Further, by the control unit, to be described later, making an attempt to access the memory, it is also possible to detect whether the ink tank is attached to the printing apparatus.

The dot count value acquired by the dot counter indicates the ink consumption and a large dot count value indicates the state where a large amount of ink is consumed. For example, by using the dot count value saved in the memory provided in the ink tank, based on the value obtained by subtracting the ink amount corresponding to the dot count value from the total capacity of the ink tank, a user is notified of the ink amount within the ink tank.

Here, by using FIG. 3, the ink supply system that communicates with the ejection port column 12PK that ejects the photo black ink is explained. The ink supply system that communicates with the ejection port column 12MK that ejects the matte black ink is the same as the ink supply system of the photo black ink, and therefore, explanation is omitted. In the following, the ink supply system that communicates with the ejection port column 12PK is referred to as "ink supply system PK" and the ink supply system that communicates with the ejection port column 12MK is referred to as "ink supply system MK". The above is the contents of the ink supply system in the present embodiment.

<About Control System of Printing Apparatus>

Figure 4:
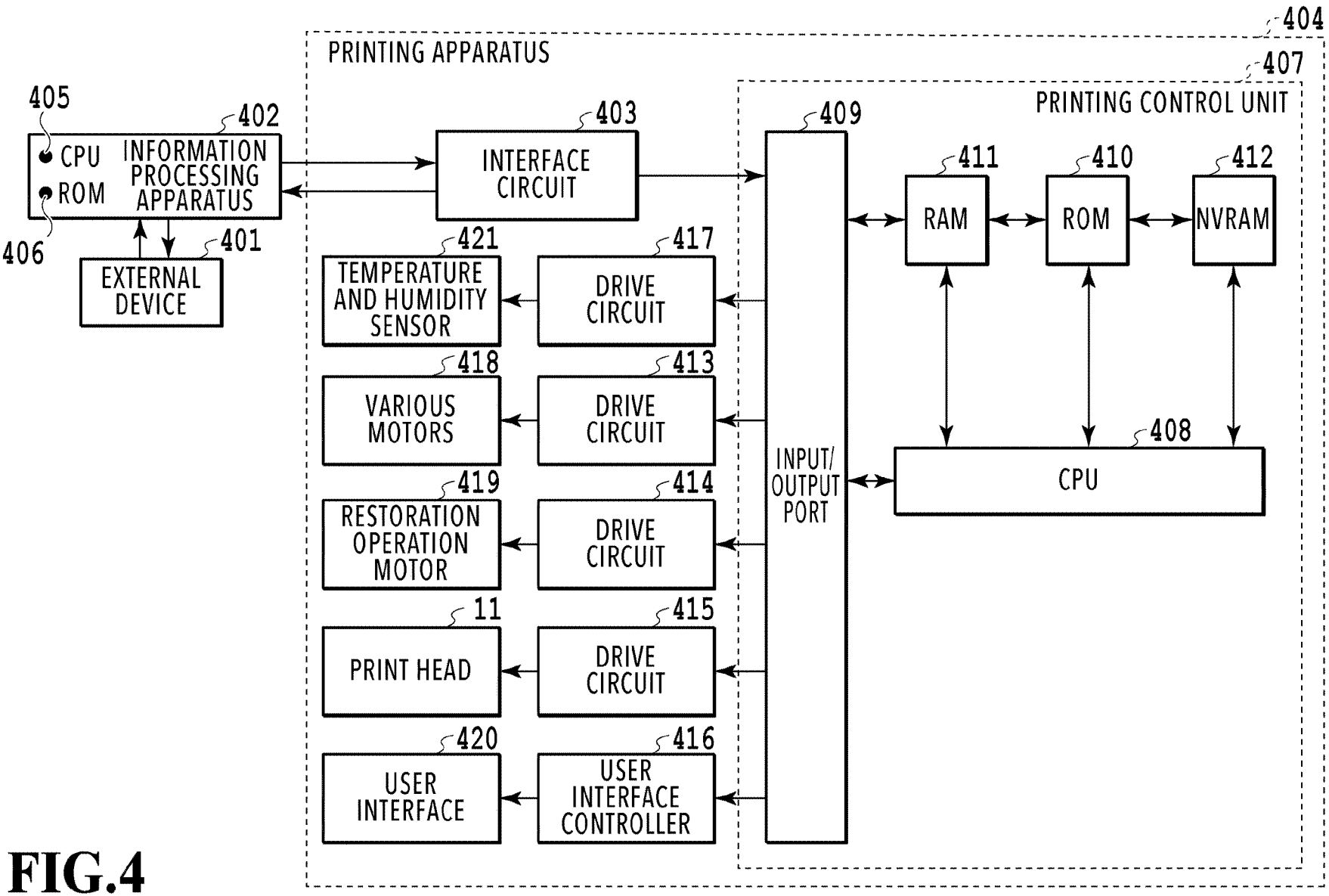
FIG. 4 is a block diagram for explaining a configuration of a control system of the ink jet printing apparatus in the first embodiment.

In the following, the configuration of the control system in the printing apparatus in the present embodiment is explained by using FIG. 4. FIG. 4 is a block diagram showing the configuration of the control system in the printing apparatus shown in FIG. 2. The system illustrated in FIG. 4 has an external device 401, an information processing apparatus 402, and a printing apparatus 404.

First, multivalued image data acquired by using the external device 401 for acquiring images of a scanner, a digital camera, and the like, and multivalued image data stored in various storage media, such as a hard disk, are input to the information processing apparatus 402. The multivalued image data is, for example, an image in the bitmap format with three channels of RGB in which each pixel is represented by a multi-value (0 to 255 and the like).

The information processing apparatus 402 is a host computer connected with the printing apparatus 404. The information processing apparatus 402 transfers information on an image to be printed to the printing apparatus 404. The image information transferred by the information processing apparatus 402 is input to a printing control unit 407 via an interface circuit 403. The information processing apparatus 402 has a CPU 405 and a ROM 406, which are necessary at the time of transferring image data.

The printing control unit 407 has a CPU 408, an input/output port 409, a ROM 410, a RAM 411, and an NVRAM 412. In the ROM 410, control programs of the CPU 408 and various kinds of data, such as parameters necessary for the printing operation, are stored. The RAM 411 and the NVRAM 412 that is a nonvolatile memory are used as a work area at the time of performing various kinds of image processing. The RAM 411 is used as a work area of the CPU 408 and at the same time, in the RAM 411, various kinds of data are stored temporarily, such as image data received from the information processing apparatus 402 and print data created based on the image data. Then, an image is formed by applying ink to a printing medium from each ejection port of the print head 11 based on the print data created in the printing control unit 407.

To the printing control unit 407, via the input/output port 409, a drive circuit 413 of various motors 418 for operating the carriage 21 and LF, a drive circuit 414 of a restoration operation motor 419, and a drive circuit 415 of the print head 11 are connected. The restoration operation motor 419 is a drive source for operating the suction pump 27 (see FIG. 2) for performing suction and discharge of ink from the print head 11.

Further, to the printing control unit 407, via the input/output port 409, a drive circuit 417 of sensors is connected, such as a temperature and humidity sensor 421 that detects temperature and humidity of the peripheral environment.

Further, to the printing control unit 407, a user interface controller 416 for controlling a user interface 420 configured by including a display unit, an operation unit, and the like, is connected. The above is the contents of the control system of the printing apparatus in the present embodiment.

<About Ink Discharge Sequence>

In the following, the ink discharge sequence that is performed at the time of preparations and the like before transporting the printing apparatus is explained by using FIG. 5. In general, in the preparation processing before the secondary transport, in order to prevent ink from leaking out of the atmosphere communication opening 311 during the transport, the ink within the sub tank 310 is discharged. In the printing apparatus of the present embodiment, as described previously, the two kinds of ink, that is, the photo black ink (PK) and the matte black ink (MK) are used, but unless explicitly described by a symbol, it is assumed that both the black inks are referred to. For example, the atmosphere communication opening 311 described previously refers to, specifically, both the atmosphere communication opening 311PK and the atmosphere communication opening 311MK.

At the time of ink discharge before the secondary transport, it is not necessarily required to completely discharge the ink within the sub tank 310. By supposing the range of the angle by which the printing apparatus is inclined during the secondary transport, it is possible to set the amount of ink to be discharged. In the present embodiment, a case is explained where the ink is discharged from the sub tank 310 by performing suction and discharge a predetermined number of times in the state where "ink insufficient" is detected for all the ink colors used in the printing apparatus.

A user gives instructions to start the ink discharge sequence via the user interface 420 provided in the printing apparatus. Specifically, by a user, who has seen the notification displayed on the display unit, pressing down the start key on the operation unit, the ink discharge sequence is started. However, the present embodiment is not limited to the example such as this and another method may be accepted, for example, it may also be possible for the ink discharge sequence to be started by instructions from the information processing apparatus 402.

In a case where the ink discharge sequence is started, first, at step S501, the CPU 408 detects that the ink tank 301 has been detached from the main body of the printing apparatus 404 by a user. The reason the processing at this step is performed is that even though suction by the suction pump 27 is performed with the ink tank 301 being attached, as long as ink remains within the ink tank 301, it is not possible to discharge the ink within the sub tank 310. Hereinafter, "step S-" is simply described as "S-".

At S502, the CPU 408 drives the suction pump 27 for a predetermined time by using the drive circuit 414 in the state where the cap 25 has been moved to the capping position. By the drive of the suction pump 27 at this step, the ink is pulled out of the sub tank 310 via the print head 11 and the cap 25.

In the present embodiment, ink is discharged by performing so-called choke suction as described in the following. In the choke suction, first, the opening/closing valve 315 provided in the ink supply tube 314 is closed. In a case where the suction pump 27 is driven in the state where the opening/closing valve 315 is closed, the pressure within the cap 25 is reduced. In a case where the opening/closing valve 315 is opened in the state of the pressure-reduced environment, the ink within the ink supply system is discharged to the maintenance cartridge by making use of the force produced in a case where the pressure returns from the negative pressure to the atmospheric pressure. In the present embodiment, it is assumed that the time during which the suction pump 27 is driven at S502 is about 40 seconds. However, the setting value of the drive time of the suction pump is not limited to about 40 seconds and the time may be shorter or longer. As long as it is possible to bring the inside of the cap 25 into the pressure-reduced environment, it may be possible to set an arbitrary time as the drive time of the suction pump 27.

In the present embodiment, each time the pump drive for about 40 seconds at S502 is performed, about 10 ml of each of the photo black ink and the matte black ink is sucked and discharged from each ejection port column. The suction amount per pump drive is not limited to this value (about 10 ml). It may be possible to set an arbitrary value as the suction amount per pump drive by appropriately setting each value of the rotation amount of the restoration operation motor 419, the pump drive time, and the like.

At S503, the CPU 408 determines whether both the ink supply system PK and the ink supply system Mk are "ink insufficient". In a case where the determination results at this steps are affirmative, the processing advances to S504 and on the other hand, in a case where the determination results are negative, the processing returns to S502. As described above, as long as the detection results in one of the supply systems of the ink colors that are used indicate "ink sufficient", the processing at S502 to S503 is repeated. In the present embodiment, in a case where "ink insufficient" in all the ink supply systems is detected (in a case of YES at S503), suction and discharge are repeated a predetermined number of times. Then, in the stage in which the suction and discharge operation such as this is completed, the processing advances to step S504.

At S504, the CPU 408 closes the opening/closing valve 315. By closing all the opening/closing valves (in the present embodiment, the opening/closing valves 315PK, 315MK), it is made possible to prevent the meniscus formed at the ejection port from being destroyed even in a case where the printing apparatus is inclined considerably during transport. Unless the meniscus is destroyed, the atmosphere does not enter from the ejection port or ink does not flow out of the ejection port, and therefore, even in a case where the printing apparatus is inclined considerably, it is unlikely that ink leaks out. It is not necessary to take into consideration the ink outflow from the supply needles 302, 305 provided in the sub tank 310. The reason is that the inner diameter of the supply needle is very small, and therefore, the exchange between air and liquid is hardly performed within the supply needle. Consequently, unless the atmosphere enters from the ejection port, the ink does not leak out of the sub tank 310 even in a case where the printing apparatus 404 is inclined considerably.

At S505, the CPU 408 stores the information on the current time in the ROM 410 as the information indicating the date the ink pulling out is completed. The above is the contents of the ink discharge sequence in the present embodiment.

About Problem to be Solved in the Present Embodiment

Figure 5:
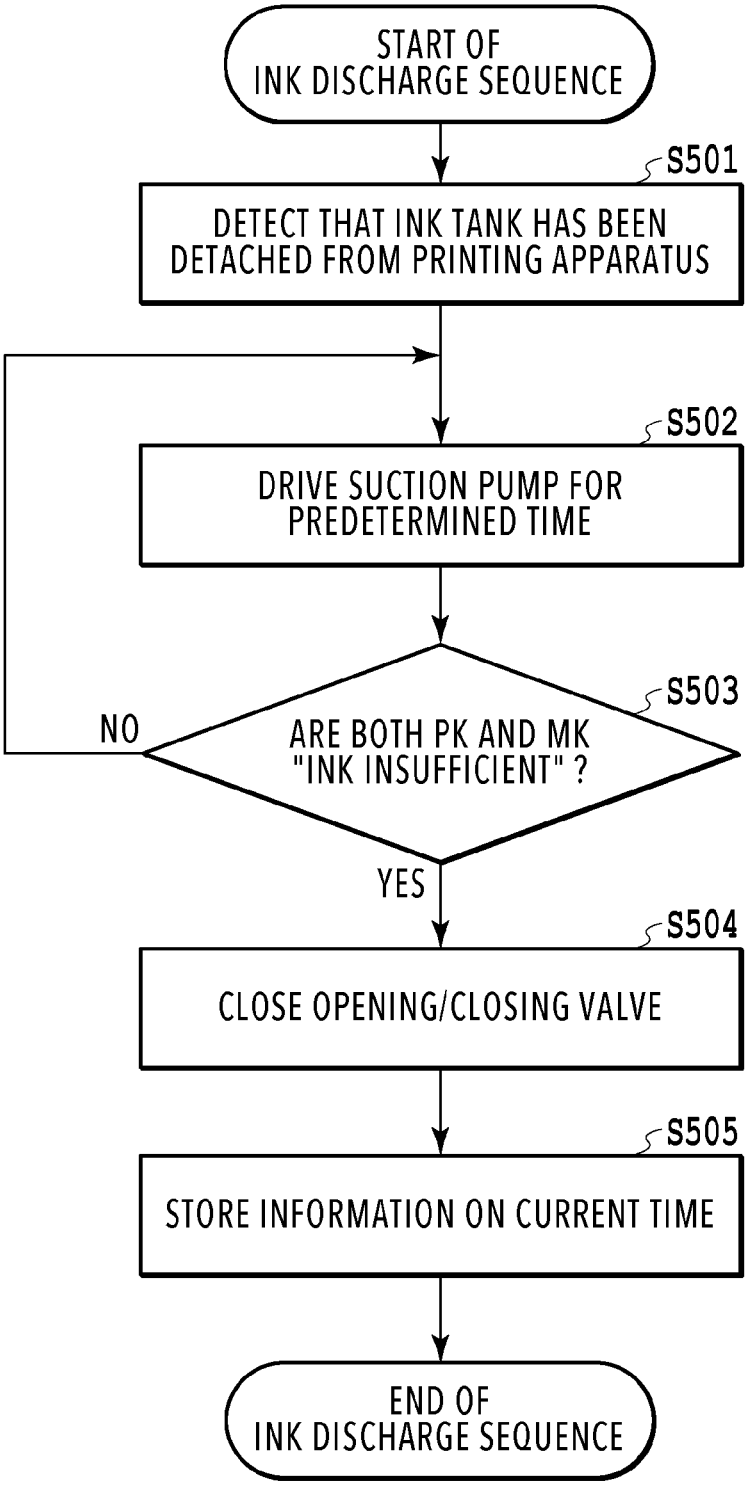
FIG. 5 is a flowchart of an ink discharge sequence in the first embodiment.

As explained by using FIG. 5, in the ink discharge sequence before transport, ink is discharged from the sub tank 310, the ink supply tube 314, and the print head 11. However, the flow path width in the ink supply tube 314 and the print head 11 is narrow, and therefore, at the time of discharging ink, an ink film forms, bubbles occur, and so on, within the flow path. The ink film and bubbles in the present embodiment are different only in shape within the flow path and from the point of view that they serve as a resistance within the flow part, which is the problem at the time of the ink filling, they can be regarded as being the same, and therefore, hereinafter, the film and the bubbles are represented together as a film.

Incidentally, aiming at improving permeability to a printing medium, a surfactant is added to ink, and therefore, the aggregation ability water originally has is reduced. Compared to water, there is a tendency for ink to be more likely to form a film at the time of exiting from the flow path and for the film to be more unlikely to break. In general, in a case where a substance whose viscosity is high is added to a liquid, the film of the liquid such as this becomes more unlikely to break. Further, the lower the temperature, the higher the viscosity of a liquid becomes, and therefore, the lower the temperature of a liquid, the more likely the liquid forms a film and the more unlikely the film breaks.

The inventors of the present application have studied and found that the film formed within the ink supply tube 314 and the flow path of the print head 11 serves as a resistance to the inflow of ink at the time of filling the printing apparatus 404 with ink. That is, there is a tendency that the larger the number of films formed within the ink supply tube 314 and the flow path of the print head 11, the larger the number of times of suction necessary at the time of the ink filling becomes.

As described above, in a case where ink is pulled out of the sub tank 310, the ink supply tube 314, and the print head 11, the ink film forms within the ink supply tube and the flow path of the print head and depending of the number of ink films within the flow path, the number of times of suction necessary at the time of the ink filling differs. Conventionally, by setting the number of times of suction at the time of the ink filling so as to be capable of dealing with the state where the largest number of ink films remains, it was made possible to complete the ink filling after transport with no problem even though ink is pulled out in any environment at the destination of a user. The strictest condition among the conditions at the time of the ink filling in the present embodiment refers to a case where, for example, ink is discharged in a low-temperature environment (specifically, 10° C. or lower) and the ink filling is performed immediately after that.

However, in a case where the number of times of suction at the time of the ink filling is set in accordance with the strictest condition, suction is performed the number of times larger than the minimum necessary number of times of suction in a case where no ink film exists within the ink supply tube 314 and the flow path of the print head 11 or the number of ink films is small. Consequently, ink is sucked excessively and as a result, there is such a problem that ink is consumed wastefully.

<About Ink Filling Sequence>

In the following, the ink filling sequence in the present embodiment is explained by using FIG. 6. The ink filling sequence is performed at the time of installation of the transported printing apparatus after the printing apparatus is transported.

First, at S601, the CPU 408 detects that the ink tank 301 has been attached to the printing apparatus 404.

At S602, the CPU 408 calculates the elapsed time from the date of completion of the ink pulling out. Specifically, the CPU 408 acquires the information indicating the date of completion of the ink pulling out, which is stored in the ROM 410 at S504 described previously, and the information on the current time and calculates the difference between the date of completion of the ink pulling out and the current time. Due to this, it is possible for the CPU 408 to calculate the elapsed time from the date of completion of the ink pulling out.

At S603, the CPU 408 determines a number of times of suction threshold value that is used at S609, to be described later, based on the elapsed time calculated at S602.

Here, the determination method of the number of times of suction threshold value, which is the feature of the present embodiment, is explained. In the ROM 410, data specifying a correspondence relationship between the elapsed time and the number of times of suction threshold value is stored, which is used at the time of determining the number of times of suction threshold value at S603. This data is, for example, a table, a formula, or the like, and created by investing in advance the number of times necessary to fill the ink supply tube 314 and the print head 11 with ink. As described previously, the number of times of suction necessary at the time of the ink filling changes depending on the number of films within the flow path. The number of films is the largest in the state immediately after ink discharge and drying of the film advances as time elapses, and therefore, the film disappears and the number of films becomes smaller. In a case where the number of films becomes smaller, the flow path resistance becomes lower. That is, the longer the elapsed time calculated at S602, the smaller the number of times of suction necessary at the time of the ink filling is. By taking into consideration the fact such as this, the number of times of suction threshold value that is determined at S603 based on the elapsed time calculated at S602 is designed so that the longer the elapsed time, the smaller the number of times of suction threshold value is. The following table shows an example of the table the CPU 408 refers to at S603. In this example, in a case where the elapsed time (referred to as Te) calculated at S602 is 24 hours or less, the number of times of suction threshold value is set to eight, which is relatively large. On the other hand, in a case where the elapsed time Te exceeds 72 hours, the number of times of suction threshold value is set to six, which is relatively small.

TABLE 1

| Number of times of suction threshold value | | | |
|---|---|---|---|
| at the time | after secondary transport, at the time of installation | | |
| of arrival | Te ≤ 24 hr | 24 hr < Te ≤ 72 hr | 72 hr < Te |
| 5 | 8 | 7 | 6 |

At S604, the ink filling of the sub tank 310 from the ink tank 301 is performed. In the present embodiment, the method that makes use of the water head difference is adopted, and therefore, it is only required to wait for the ink to move from the ink tank 301 to the sub tank 310 as time elapses.

At S605, the CPU 408 determines whether the state within the sub tank 310 is "ink sufficient". At the point in time the ink liquid surface that rises within the sub tank 310 reaches or exceeds the detection surface E1 shown in FIG. 3, the determination results at S605 become affirmative. A case where the determination results at S605 are affirmative indicates that the ink filling of the sub tank 310 from the ink tank 301 is completed, and therefore, in order to fill the ink supply tube 314 and the print head 11 with ink subsequently, the processing advances to S606. On the other hand, a case where the determination results at S605 are negative indicates that the ink filling of the sub tank 310 from the ink tank 301 is not completed, and therefore, the ink filling of the sub tank 310 from the ink tank 301 is continued.

At S606, the CPU 408 initializes a parameter (referred to as suction Count) for counting the number of times of suction by the suction pump performed at the time of the ink filling, specifically, the CPU 408 sets the value of suction Count to zero.

At S607, the CPU 408 moves the cap 25 to the capping position. Then, in that state, the suction pump 27 is driven for a predetermined time by using the drive circuit 414. By the drive of the suction pump 27 at this step, ink spreads gradually into the ink supply tube 314 and the flow path in the print head 11.

At S608, the CPU 408 increments the value of suction Count (adds 1).

At S609, the CPU 408 determines whether the value of suction Count is equal to the number of times of suction threshold value determined at S603. In a case where the determination results at this step are affirmative, the series of processing is terminated. On the other hand, in a case where the determination results are negative, the processing returns to S607.

The processing at steps S606 to S609 is processing for the purpose of filling the ink supply tube 314 and the flow path in the print head 11 with ink from the sub tank 310 and suction is repeated until the threshold value determined at step S603 is reached.

Figure 6:
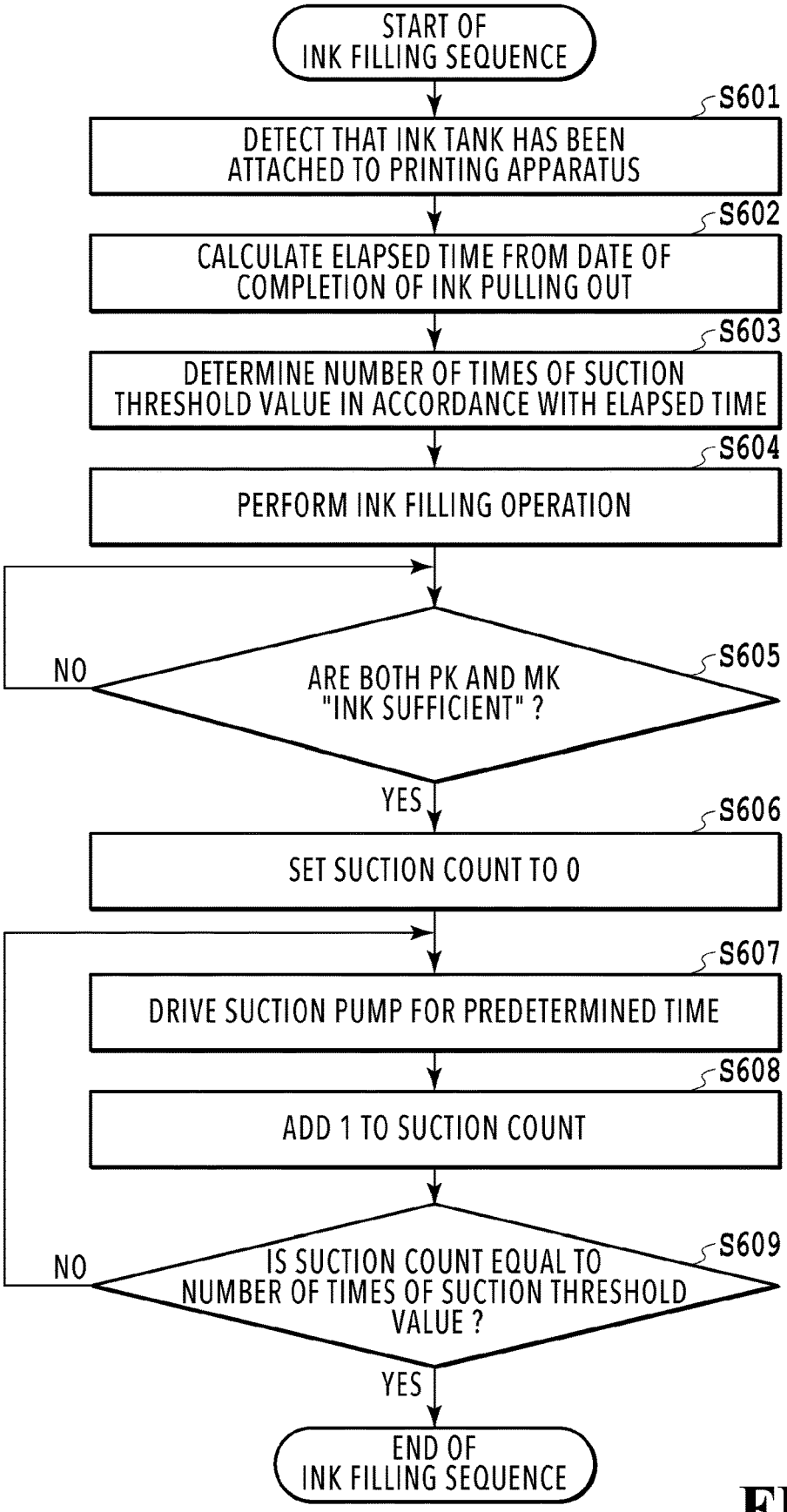
FIG. 6 is a flowchart of an ink filling sequence in the first embodiment.

As described above, in the ink filling sequence explained by using FIG. 6, in accordance with the elapsed time from the date the ink pulling out is performed, the number of times of suction to be performed at the time of the ink filling is adjusted. Specifically, the longer the elapsed time from the date the ink pulling out is performed, the smaller the number of times of suction to be performed at the time of the ink filling is set. The above is the contents of the ink filling sequence in the present embodiment.

According to the present embodiment, in a case of refilling the ink supply system of the printing apparatus with ink, from which ink was pulled out once, it is made possible to optimize the time necessary for filling and the ink discharge amount in accordance with the state within the flow path. That is, it is possible to shorten the time necessary for the ink refilling after the secondary transport and reduce the ink discharge amount.

Second Embodiment

In the first embodiment, the number of times of ink suction is changed in accordance with the elapsed time from the ink pulling out in the ink discharge sequence, which is performed before the secondary transport, to the start of the ink filling performed at the time of installation after the secondary transport. In contrast to this, in the present embodiment, the number of times of suction is changed depending on whether or not the ink discharge sequence is performed before the ink filling.

As described previously, in a case where the ink discharge sequence is performed, the ink film occurs within the ink supply tube 314 and the flow path in the print head 11 and the ink film serves as a resistance at the time of the ink filling afterward. However, the ink discharge sequence such as this is not necessarily performed at all times for the purpose of the ink pulling out. In the present embodiment, attention is focused on a case where the ink discharge sequence is not performed before the ink filling sequence. In the following, contents different from the embodiment described previously are explained in detail and explanation of the same contents as those of the embodiment described previously is omitted appropriately.

<About Ink Pulling Out Method>

The method of pulling out ink from the ink supply tube 314 in the present embodiment is explained. For example, in a case where the carriage 21 attached to the printing apparatus 404 fails, it is necessary to remove the carriage 21 and replace it with another. At that time, in order to prevent ink from leaking out of the apparatus through the ink supply tube 314, it is necessary to discharge in advance the ink from the ink supply tube 314. In such a case, the printing apparatus 404 is not transported to another position, and therefore, it is not necessary to discharge the ink from the sub tank 310. Consequently, the print head 11 is removed from the carriage 21 in the state where the opening/closing valve 315 is left open and the ink is caused to drop into the sub tank 310 from the ink supply tube 314 by its own weight. In the following, by using FIG. 7A and FIG. 7B, the ink pulling out method in the present embodiment is explained specifically.

Figure 7A:
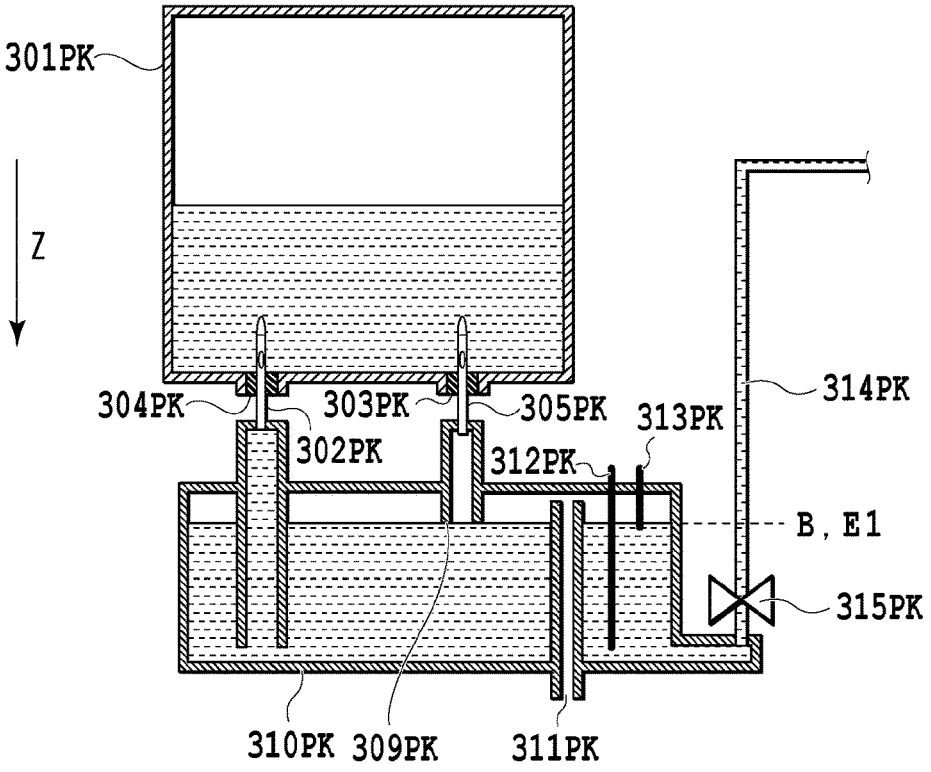
FIG. 7A and FIG. 7B are diagrams for explaining an ink pulling out method without performing an ink discharge sequence in a second embodiment.

FIG. 7A shows the state immediately after the print head 11 is removed with the opening/closing valve 315 being left open. In a case where the print head 11 is removed, the meniscus formed at the ejection port of the print head 11 described previously does not exist, and therefore, it is not possible to maintain the negative pressure caused by the water head difference. Because of this, the ink in the ink supply tube 314PK drops downward in the gravitational direction, that is, into the sub tank 310PK in accordance with the water head difference.

Figure 7B:
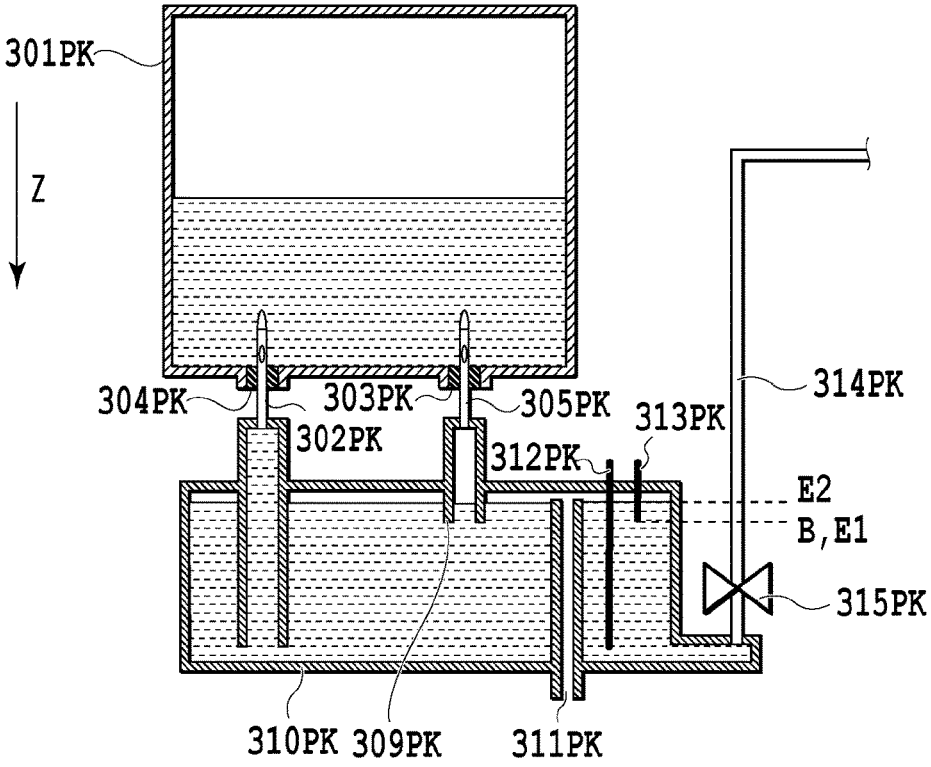

FIG. 7B shows the state where the ink in the ink supply tube 314PK has dropped fully into the sub tank 310PK. A liquid surface E2 in FIG. 7B indicates the liquid surface as a result of that the original liquid surface E1 has risen by an amount corresponding to the amount of ink that has dropped. The design is made so that the liquid surface E2 is lower than the opening on the upper side of the atmosphere communication opening 311PK, and therefore, the ink does not leak out of the atmosphere communication opening 311PK.

In a case where ink is pulled out of the ink supply tube 314 by the procedure such as this, the ink discharge sequence is not performed and ink is not pulled out of the print head 11, and therefore, no ink film forms within the flow path of the print head 11. Consequently, the resistance at the time of the ink filling sequence differs depending on whether or not the ink discharge sequence is performed before the ink filling sequence is performed. Because of this, the number of times of suction necessary at the time of the ink filling sequence differs depending on whether or not the ink discharge sequence is performed before the ink filling sequence is performed.

<About Ink Discharge Sequence and Ink Filling Sequence>

Figure 8:
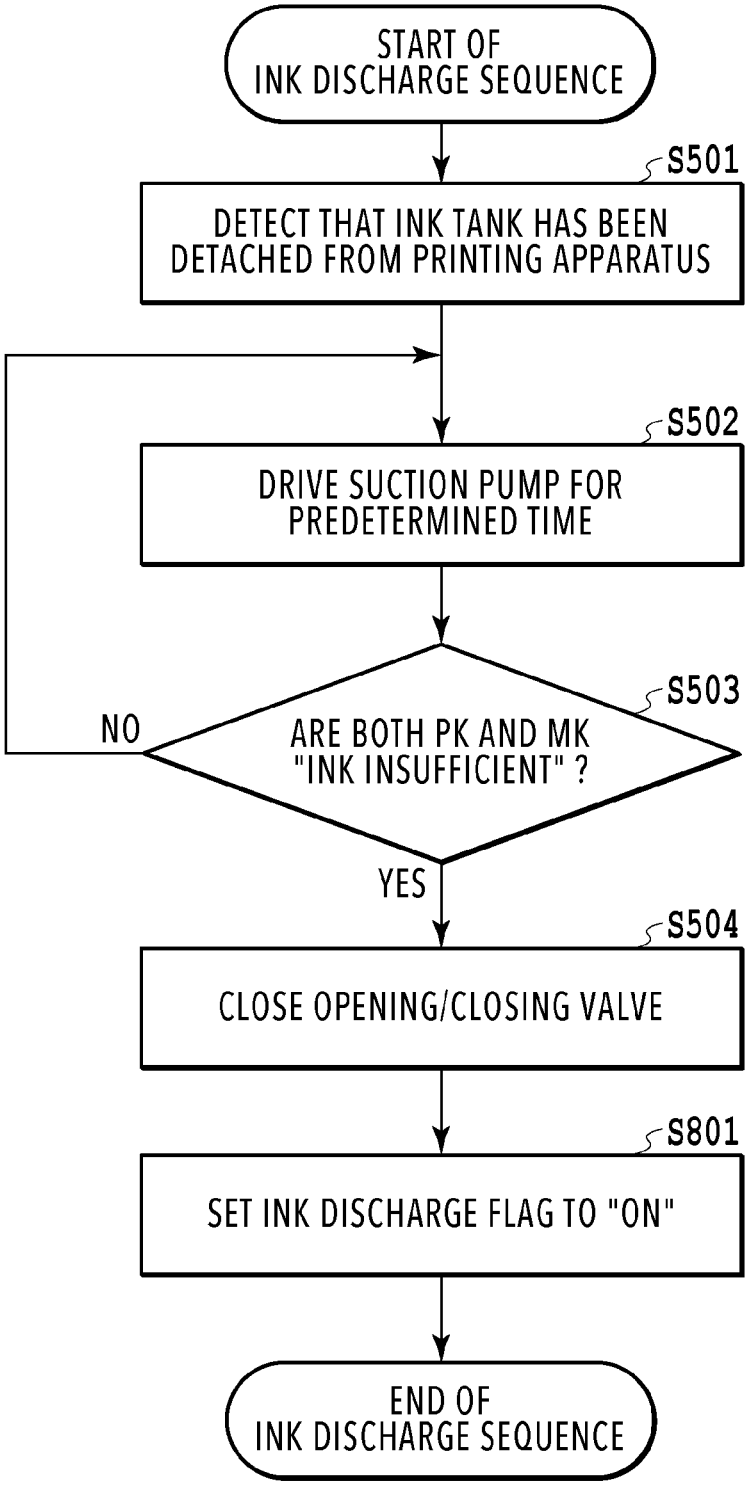
FIG. 8 is a flowchart of the ink discharge sequence in the second embodiment.

In the following, the ink discharge sequence in the present embodiment is explained by using FIG. 8. The processing at S501 to S504 is the same as that of the first embodiment (see FIG. 5).

At S801 after S504, the CPU 408 stores the value of an ink discharge flag indicating whether or not the ink discharge sequence has been performed in the ROM 410 after setting the value to a value of "On" indicating that the ink discharge sequence has been performed. The processing at this step is performed for the purpose of making it possible to determine whether the ink discharge sequence has been performed in the ink filling sequence to be performed later. The ink discharge sequence in the present embodiment differs from that of the first embodiment described previously in that this step exists.

Figure 9:
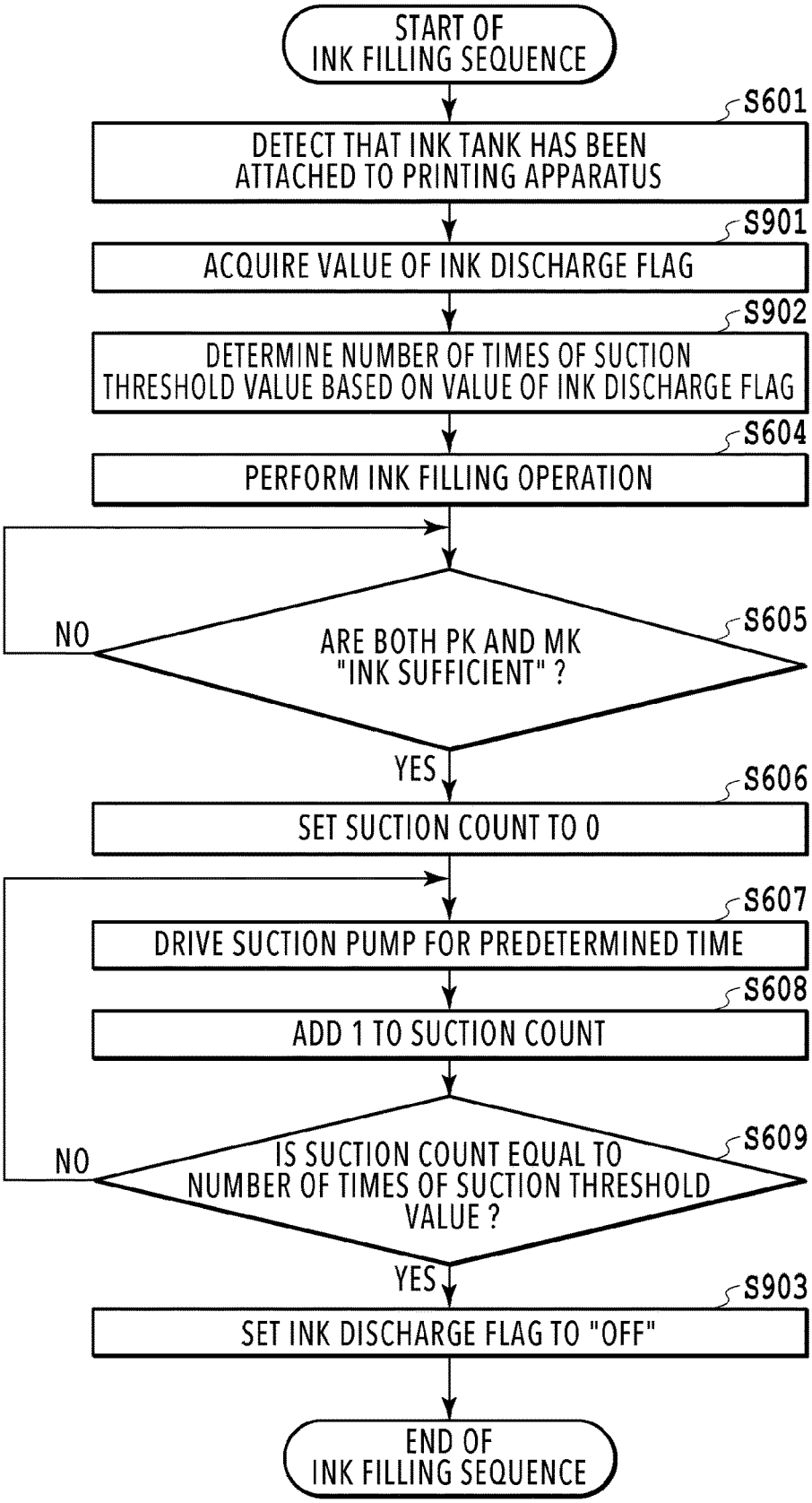
FIG. 9 is a flowchart of an ink filling sequence in the second embodiment.

Next, the ink filling sequence in the present embodiment is explained by using FIG. 9. As in the first embodiment (see FIG. 6), in the present embodiment also, at S601, the CPU 408 detects that the ink tank 301 has been attached to the printing apparatus 404 at S601.

At S901 after S601, the CPU 408 acquires the value of the ink discharge flag, which is stored in the ROM 410 at S801.

At S902, the CPU 408 determines the number of times of suction threshold value based on the value of the ink discharge flag, which is acquired at S901. In the present embodiment, the number of times of suction threshold value is made to differ between a case where the ink discharge sequence is performed and a case where the ink discharge sequence is not performed. Specifically, the number of times of suction threshold value in a case where the ink discharge sequence is performed is set larger than that in a case where the ink discharge sequence is not performed. In the present embodiment, whether or not the ink discharge sequence has been performed is determined by setting the flag in the ink discharge sequence and checking the flag in the ink filling sequence, but it may also be possible to adopt a method other than the flag management.

The processing at step S604 and subsequent steps is the same as that in the first embodiment (see FIG. 6) and by the processing at S607 to S609, suction is repeated until the number of times of suction reaches the number of times of suction threshold value and the ink filling is completed.

Lastly, at step S903, the CPU 408 stores the value of the ink discharge flag in the ROM 410 after setting the value to a value of "Off" indicating that the ink discharge sequence has not been performed. By this step, it is made possible to determine whether the ink discharge sequence has been performed also at the time of performing the ink filling again. The above is the contents of the ink discharge sequence and the ink filling sequence, which are characteristic in the present embodiment.

In the present embodiment, at the time of pulling out ink from the supply tube, the number of times of suction to be performed at the time of the ink filling is changed in accordance with whether the ink discharge sequence is performed. Due to this, it is made possible to optimize the time necessary for the ink filling and the ink consumption.

Third Embodiment

In the first embodiment, the number of times of suction is changed in accordance with the elapsed time from the ink pulling out in the ink discharge sequence. In contrast to this, in the present embodiment, the number of times of suction is changed in accordance with the temperature at the time of execution of the ink discharge sequence.

As described previously, in a case where the ink discharge sequence is performed, the ink film occurs within the ink supply tube 314 and the flow path in the print head 11 and the ink film serves as a resistance at the time of the ink filling, but the higher the temperature, the more unlikely the ink film occurs and the more likely the ink film disappears. Consequently, the present embodiment focuses attention on that the degree of occurrence of the ink film is different and the resistance in the tube and the flow path within the head is different in accordance with the ink temperature.

<About Ink Discharge Sequence and Ink Filling Sequence>

Figure 10:
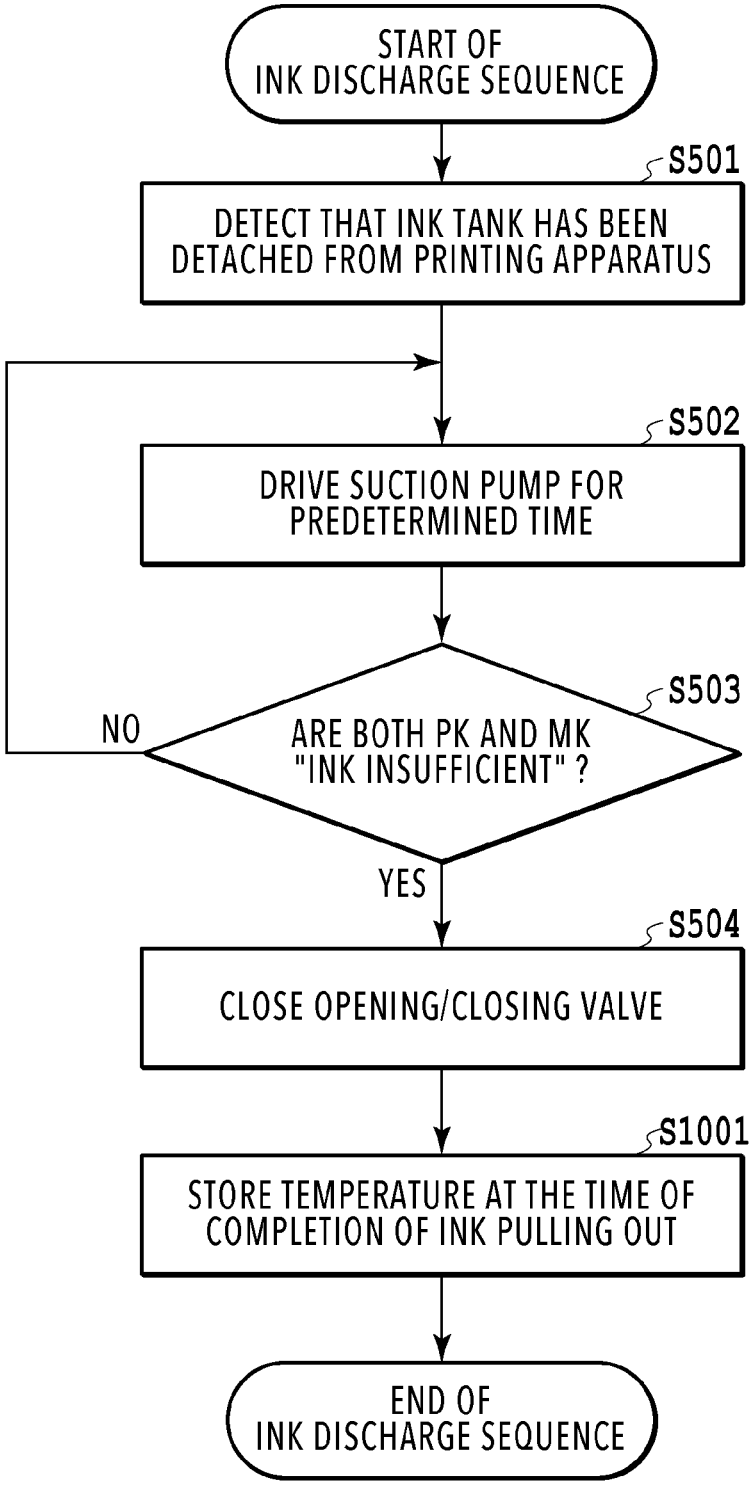
FIG. 10 is a flowchart of an ink discharge sequence in a third embodiment.

In the following, the ink discharge sequence in the present embodiment is explained by using FIG. 10. The ink discharge sequence of the present embodiment is basically the same as the ink discharge sequence of the first embodiment (see FIG. 5), but is different from that of the first embodiment in that S1001 exists in place of S505. To explain in detail, in the first embodiment, the information on the date the ink pulling out is completed is stored, but in the present embodiment, the information on the temperature at the time of completion of the ink pulling out is stored. As the temperature information such as this, in a case where the printing apparatus 404 has a unit (for example, a diode sensor) configured to measure the ink temperature, it may be possible to make use of the information on the ink temperature measured by the unit. Alternatively, as the temperature information, in a case where the printing apparatus 404 has a thermometer that measures the environment temperature of the printing apparatus 404, it may be possible to make use of the information on the environment temperature measured by the thermometer. In the present embodiment, it is assumed that the value of the temperature/humidity sensor connected to the main body of the printing apparatus 404 is used.

Figure 11:
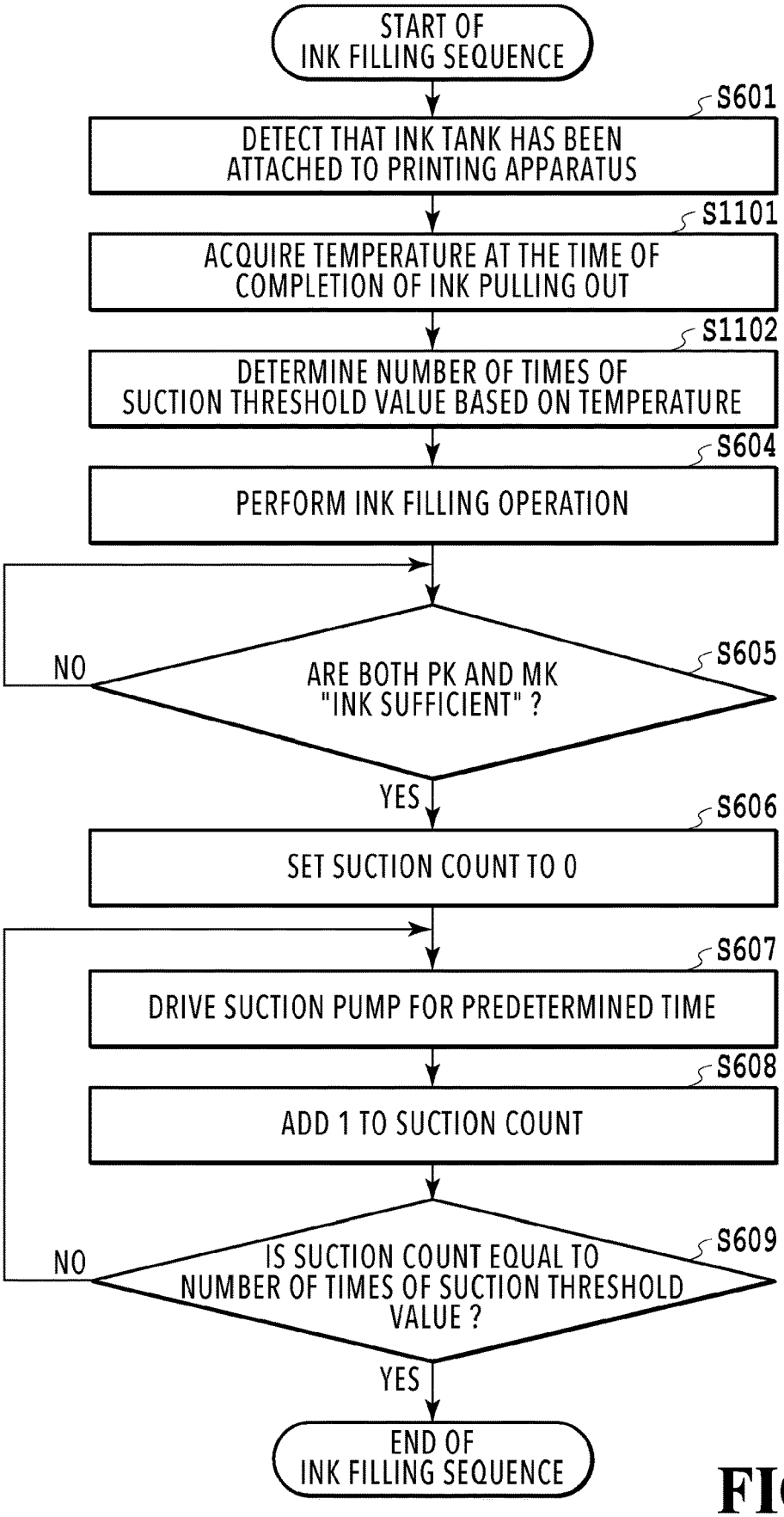
FIG. 11 is a flowchart of an ink filling sequence in the third embodiment.

Next, the ink filling sequence in the present embodiment is explained by using FIG. 11.

At S1101, the CPU 408 acquires the temperature at the time of completion of the ink pulling out, which is stored at S1001.

At S1102, the CPU 408 determines the number of times of suction threshold value to be used at S609, to be described later, based on the temperature acquired at S1101.

As described above, the filling operation itself in the present embodiment is the same as that in the first embodiment (see FIG. 6), but characterized in that the number of times of suction to be performed at that time of the ink filling is changed based on the temperature at the time of completion of the ink pulling out, which is acquired at S1101. More specifically, the number of times of suction at the time of filling is reduced by setting the number of times of suction threshold value so that the higher the temperature at the time of completion of the ink pulling out, the smaller the number of times of suction threshold value is. The above is the contents of the ink discharge sequence and the ink filling sequence, which are characteristic in the present embodiment.

Modification Example

In the present embodiment, the temperature information is acquired at the time of execution of the ink discharge sequence and based on the acquired temperature information, the number of times of suction in the ink filling sequence is determined. Due to this, it is made possible to optimize the time necessary for the ink filling and the ink consumption.

In the present embodiment, in accordance with the temperature at the time of the ink pulling out, the number of times of suction at the time of the ink filling is changed, but it may also be possible to change the number of times of suction at the time of the ink filling in accordance with the humidity at the time of the ink pulling out. In a case where the humidity is low, the film that occurs within the ink flow path at the time of completion of the ink pulling out is likely to break, but on the other hand, in a case where the humidity is high, the film is unlikely to break, and therefore, it is recommended to set the optimum number of times of suction appropriately in accordance with the humidity at the time of the ink pulling out.

OTHER EMBODIMENTS

In the embodiment described previously, the supply system is explained in which one supply tube is provided to the combination of one ink tank and one sub tank, but it may also be possible to provide two or more supply tubes to the one combination such as this. In that case, the ink discharge amount in the one-time suction operation is double that in a case where one supply tube is provided, and therefore, there is a tendency for the actual difference between the discharge amount and the suction amount.

Further, in each of the first to third embodiments, the number of times of suction is determined by referring to one of the elapsed time, whether or not the ink discharge sequence is performed, and the temperature, but it may also be possible to determine the number of times of suction by using two or more of them. For example, in a case where the number of times of suction is determined based on the two conditions of the elapsed time and the temperature, a more accurate optimization of the number of times of suction is made possible.

Further, in the embodiment described previously, the ink discharge or the ink filling is performed by repeating the choke suction, but it is also possible to apply the idea of the present application to the suction method (so-called normal suction) in which the pump drive is performed with the opening/closing value being left open. Further, it may also be possible to perform the two suction methods in a mixed manner, such as that the normal suction is performed at the time of the ink discharge and the choke suction is performed at the time of the ink filling.

In the embodiment described previously, explanation is given with the serial print head capable of performing so-called multi-pass printing that prints an image by conveying a printing medium during a plurality of times of scan. It is also possible to apply the idea of the present application to a so-called full-line print head that prints an image by a one-time scan by using a print head comprising a plurality of ejection port columns in the area corresponding to the width of a printing medium.

Further, it is possible to apply the idea of the present application to all the apparatuses that perform printing on a printing medium, such as paper, cloth, a non-woven fabric, and an OHP film, and the kind of printing medium is not limited. As a specific example of the apparatus to which the idea of the present application is applied, it is possible to enumerate a business machine, such as a printer, a copy machine, and a facsimile, and an industrial apparatus, such as a mass-production machine and a semiconductor element manufacturing apparatus.

Further, in the embodiment described previously, the aspect is explained in which the printing control unit 407 that performs the characteristic processing, such as supply control, of the present disclosure, is comprised inside the printing apparatus 404, but the printing control unit such as this does not need to be comprised inside the printing apparatus. For example, it may also be possible to cause the printer driver that is installed in the information processing apparatus 402 connected with the printing apparatus 404 to have the function of the printing control unit 407. The printing system configured by including the information processing apparatus and the printing apparatus as described above is also included in the category of the idea of the present application. In this case, the information processing apparatus functions as the control apparatus that controls the printing apparatus as well as functioning as the data supply apparatus that supplies data to the printing apparatus.

It may also be possible to use the first to sixth embodiments described previously b appropriately combining the configuration of each embodiment.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to one embodiment of the present disclosure, it is made possible to optimize the time necessary for filling and the ink consumption in a case where a printing apparatus whose ink has run short is filled with ink from an ink supply path connecting an ink storage unit and a print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-083712, filed Apr. 25, 2019, which is hereby incorporated by reference wherein in its entirety.

What is claimed is:

1. A printing apparatus comprising:

a storage unit configured to store ink;

a print head having an ejection port from which ink supplied from the storage unit is ejected;

an ink supply path that connects the storage unit and the print head;

a discharge unit configured to discharge ink from the ejection port; and a control unit configured to control the discharge unit to execute a discharge operation of discharging ink inside the ink supply path and the print head through the ejection port, wherein, in a case where a filling operation of filling the ink supply path and the print head with ink is executed after a prior discharge operation, the control unit controls a drive time of the discharge unit so that the drive time in a case where an elapsed time from the prior discharge operation is greater than a threshold is less than the drive time in a case where the elapsed time is less than the threshold.

2. The printing apparatus according to claim 1, further comprising an acquisition unit which acquires information on a date the discharge operation is completed, wherein the control unit controls the discharge unit according to the elapsed time based on the information.

3. The printing apparatus according to claim 1, wherein the control unit controls the discharge unit to perform the discharge operation in a case where preparation before transport of the printing apparatus is executed.

4. The printing apparatus according to claim 3, wherein the control unit controls the discharge unit to perform the discharge operation so that ink in the storage unit is not discharged completely in a case where preparation before transport of the printing apparatus is executed.

5. The printing apparatus according to claim 3, wherein the control unit controls the discharge unit to discharge ink from the ejection port in a case where the printing apparatus is installed after the transport.

6. The printing apparatus according to claim 1, wherein, in a case where the filling operation of filling the ink supply path and the print head with ink is executed after the prior discharge operation, the control unit controls the drive time of the discharge unit so that a number of times of discharge in a case where the elapsed time is greater than the threshold is less than the number of times of discharge in a case where the elapsed time is less than the threshold.

7. A control method of a printing apparatus, wherein the printing apparatus comprises:

a storage unit configured to store ink;

a print head having an ejection port from which ink supplied from the storage unit is ejected;

an ink supply path that connects the storage unit and the print head; and a discharge unit configured to discharge ink from the ejection port;

the control method comprising:

controlling the discharge unit to execute a discharge operation of discharging ink inside the ink supply path and the print head through the ejection port, wherein, in a case where a filling operation of filling the ink supply path and the print head with ink is executed after a prior discharge operation, a drive time of the discharge unit is controlled so that the drive time in a case where an elapsed time from the prior discharge operation is greater than a threshold is less than the drive time in a case where the elapsed time is less than the threshold.

8. The control method according to claim 7, further comprising controlling the discharge unit to perform the discharge operation in a case where preparation before transport of the printing apparatus is executed.

9. The control method according to claim 8, further comprising controlling the discharge unit to discharge ink from the ejection port in a case where the printing apparatus is installed after the transport.

10. A printing apparatus comprising:

a storage unit configured to store ink;

a print head having an ejection port from which ink supplied from the storage unit is ejected;

an ink supply path that connects the storage unit and the print head;

a discharge unit configured to discharge ink from the ejection port; and a control unit configured to control the discharge unit to execute a discharge operation of discharging ink inside the ink supply path and the print head through the ejection port, wherein, in a case where a filling operation of filling the ink supply path and the print head with ink is executed after a prior discharge operation, the control unit controls a drive time of the discharge unit so that the drive time in a case where an elapsed time from the prior discharge operation is greater than a threshold is less than the drive time in a case where the elapsed time is less than the threshold, wherein the control unit determines a number of times of discharge by the discharge unit based on temperature information, such that the number of times of discharge in a case where a temperature indicated by the temperature information is higher than first temperature is smaller than the number of times of discharge in a case where the temperature is second temperature which is lower than the first temperature.

11. The printing apparatus according to claim 10, wherein the control unit controls the discharge unit to perform the discharge operation in a case where preparation before transport of the printing apparatus is executed.

12. The printing apparatus according to claim 11, wherein the control unit controls the discharge unit to discharge ink from the ejection port in a case where the printing apparatus is installed after the transport.

13. A control method of a printing apparatus, wherein the printing apparatus comprises:

a storage unit configured to store ink;

a print head having an ejection port from which ink supplied from the storage unit is ejected;

an ink supply path that connects the storage unit and the print head; and a discharge unit configured to discharge ink from the ejection port;

the control method comprising:

controlling the discharge unit to execute a discharge operation of discharging ink inside the ink supply path and the print head through the ejection port;

wherein, in a case where a filling operation of filling the ink supply path and the print head with ink is executed after a prior discharge operation, a drive time of the discharge unit is controlled so that the drive time in a case where an elapsed time from the prior discharge operation is greater than a threshold is less than the drive time in a case where the elapsed time is less than the threshold;

acquiring temperature information in a case where the discharge is performed; and determining a number of times of discharge by the discharge unit based on the temperature information, such that the number of times of discharge in a case where a temperature indicated by the temperature information is higher than a first temperature is smaller than the number of times of discharge in a case where the temperature is a second temperature which is lower than the first temperature.

14. The control method according to claim 13, further comprising controlling the discharge unit to perform the discharge operation in a case where preparation before transport of the printing apparatus is executed.

15. The control method according to claim 14, further comprising controlling the discharge unit to discharge ink from the ejection port in a case where the printing apparatus is installed after the transport.

* * * * *